US007014047B2

(12) United States Patent
Stapleton

(10) Patent No.: US 7,014,047 B2
(45) Date of Patent: Mar. 21, 2006

(54) TWO-PIECE INTERLOCKING CORNER PROTECTOR

(75) Inventor: Chris Stapleton, Menasha, WI (US)

(73) Assignee: Great Northern Corporation, Appleton, WI (US)

( * ) Notice: Subject to any disclaimer, the term of this patent is extended or adjusted under 35 U.S.C. 154(b) by 93 days.

(21) Appl. No.: 10/757,946

(22) Filed: Jan. 15, 2004

(65) Prior Publication Data

US 2004/0144685 A1 Jul. 29, 2004

Related U.S. Application Data

(60) Provisional application No. 60/440,817, filed on Jan. 17, 2003.

(51) Int. Cl.
*B65D 81/05* (2006.01)

(52) U.S. Cl. ..... 206/586; 206/453; 248/345.1; 108/55.1

(58) Field of Classification Search ..... 206/451, 206/453, 586; 211/43; 248/189.9, 345.1; 108/55.1

See application file for complete search history.

(56) References Cited

U.S. PATENT DOCUMENTS

| | | | | | |
|---|---|---|---|---|---|
| 3,844,415 | A | * | 10/1974 | Heimann | 211/43 |
| 4,292,901 | A | * | 10/1981 | Cox | 108/55.1 |
| 4,553,484 | A | * | 11/1985 | Cox | 108/55.1 |
| 5,115,917 | A | * | 5/1992 | Schrage | 206/586 |
| 5,678,691 | A | * | 10/1997 | Amado-Aguilar et al. | 206/451 |
| 6,478,354 | B1 | * | 11/2002 | Eyal | 294/74 |

* cited by examiner

*Primary Examiner*—David T. Fidei
(74) *Attorney, Agent, or Firm*—Andrus, Sceales, Starke & Sawall, LLP

(57) ABSTRACT

A product protector for use in protecting three sides of a product being shipped. The product protector includes a pair of corner protectors joined to each other to define a smooth inner surface without the use of external connectors. Each corner protector is formed from an inner layer and an outer layer, where one leg of the corner protector includes an overlap portion having a reduced thickness. The inner layer and the outer layer are secured to each other along only one of the two legs such that the inner layer and outer layer can separate along the other of the two legs. When a pair of corner protectors are attached to each other, the overlap area of the first corner protector is positioned between the inner and outer layers of the second corner protector to define the U-shaped edge protector.

12 Claims, 3 Drawing Sheets

TWO-PIECE INTERLOCKING CORNER PROTECTOR

CROSS REFERENCE TO RELATED APPLICATION

This application is based on and claims priority from Provisional U.S. Patent Application Ser. No. 60/440,817 filed Jan. 17, 2003.

BACKGROUND OF THE INVENTION

The present invention generally relates to a package protector for use in shipping articles. More specifically, the present invention relates to a package protector that provides three sided protection for difficult to manage, narrow items and can be compactly stored and quickly assembled without external components.

Presently, edge protectors are available having a generally V-shape cross-section to protect the edges of products being shipped within a storage container or to provide external protection of stacked articles. The edge protectors are formed from a laminated paperboard material. The V-shaped edge protectors are presently used to provide protection to two sides of a product being shipped.

Currently, if a narrow, long item such as a window, door or panel needs to be shipped, a pair of V-shaped edge protectors are attached to each other to create a U-shaped protector that provides protection for three sides of the product to be shipped. Typically, the two V-shaped edge protectors are coupled to each other by overlapping one of the legs of each protector and riveting the two protector legs together along the overlap area. Although a pair of riveted connect protectors are able to provide protection to three sides of a product, the rivets can scratch the product being shipped and the overlapping surface could possibly mar the product being shipped.

An additional disadvantage of the currently available product is that the riveted protector requires more room for storage and requires an additional step to construct.

An additional method of providing three-side protection is to use a pre-formed laminated paperboard product with a U-shaped cross-section. Key disadvantages of this product are that the product does not nest well, so the U-shaped product takes up much room during storage and shipment.

Therefore, a need currently exists for a product protector that can be easily stored and assembled by an end user to provide protection for three sides of a product being shipped. Further, a need exists for a product protector formed from laminated paperboard that provides a smooth inner surface to prevent damage to a product being shipped.

SUMMARY OF THE INVENTION

The present invention is a product protector for protecting three edges of a product being shipped. The product protector is formed from a pair of corner protectors joined to each other to define a generally U-shape to protect three edges of a product. Each of the corner protectors can be easily mated with another corner protector to define the U-shape of the product protector.

Each of the corner protectors is formed from an inner layer and an outer layer each formed from laminated paperboard. Both the inner layer and the outer layer have a generally V-shape and are configured to be placed adjacent to each other to define a single corner protector. The outside layer of the corner protector has a first leg and a second leg having similar dimensions. The inner layer also is V-shaped and has a first leg generally corresponding to the length of the first leg of the outer layer. The first leg of the inner and outer layer are secured to each other by an adhesive.

The second leg of the inner layer is shorter than the second leg of the outer layer to create an overlap area between the outer edges of the second leg of the inner layer and the second leg of the outer layer. In accordance with the present invention, the second leg of the inner layer is not secured to the second leg of the outer layer such that the two legs can be separated during mating with another V-shaped corner protector.

When a pair of corner protectors are mated, the overlap area of the first corner protector is positioned between the second leg of the inner and outer layers of the second corner protector. Thus, the combination of the two corner protectors creates a smooth inside surface and does not need external devices, such as rivets, to secure the two components to each other.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
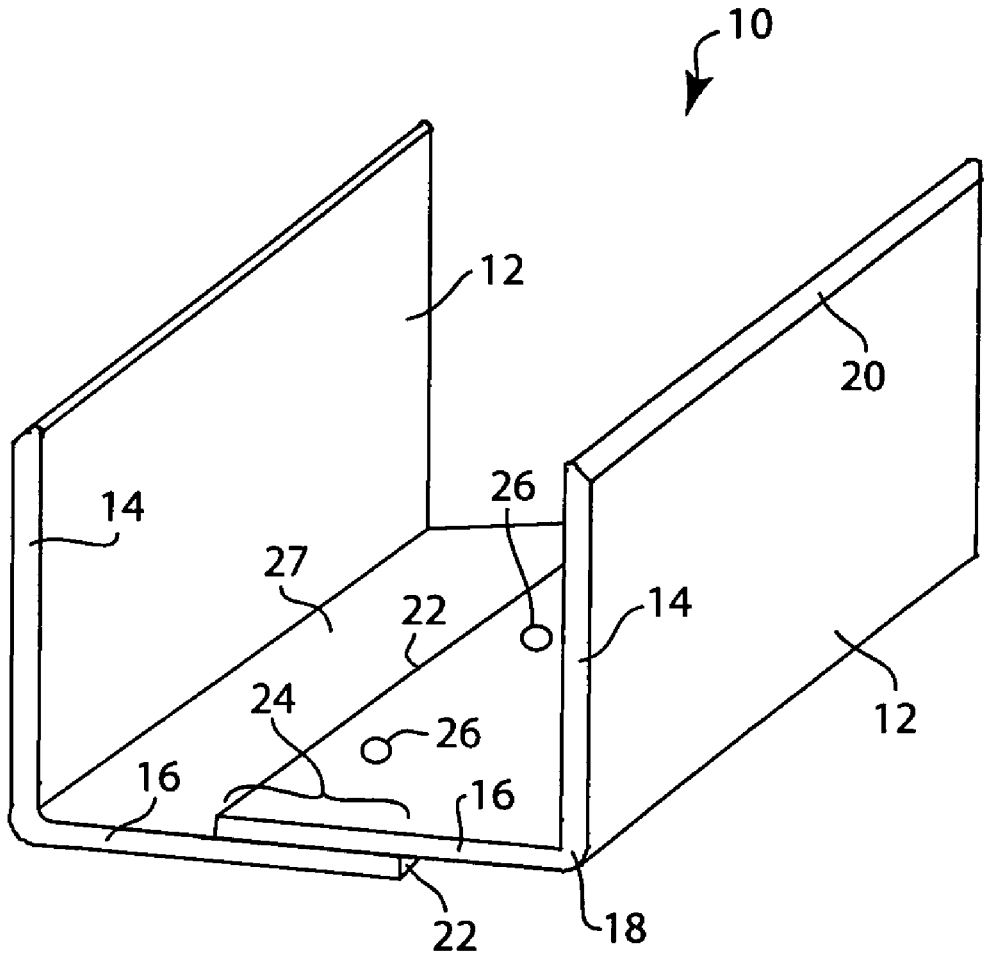
FIG. 1 is a perspective view illustrating the prior art system utilizing a pair of laminated paperboard corner protectors attached to each other by rivets.

Referring first to FIG. 1, thereshown is a prior art U-shaped edge protector 10 that can be utilized to provide three-sided protection for difficult to manage, long, narrow items such as windows, doors and panels. The edge protector 10 is formed from a pair of corner protectors 12 joined to each other to define the general U-shape. Each of the corner protectors 12 includes a first leg 14 and a second leg 16 joined to each other along a 90° corner 18 such that each corner protector 12 has a generally V-shape. The first leg 14 is defined by a top edge 20 while the second leg 16 is defined by an outer edge 22. In the preferred embodiment of the invention, each of the corner protectors 12 are formed from laminated paperboard.

As illustrated in FIG. 1, the corner protectors 12 are positioned relative to each other such that the first corner protector overlaps the second corner protector along an overlap area 24. A series of rivets 26 are spaced along the overlap area 24 to join the legs 16 of the aligned corner protectors 12. The rivets 26 securely join the corner protectors 12 to provide a durable U-shaped edge protector.

Although the edge protector 10 illustrated in FIG. 1 provides the required protection for the sides of a long, narrow item, the rivets 26 contact an edge of the product being protected and could possibly mar the outer surface of the product. Further, the outer edge 22 of the corner protector 12 extends above the inner face surface 27 of the overlapped leg, which could also mar a delicate product being shipped. Therefore, although the edge protector 10 of the present invention can be used for many packaging applications, a need exists for an improved edge protector.

Figure 2:
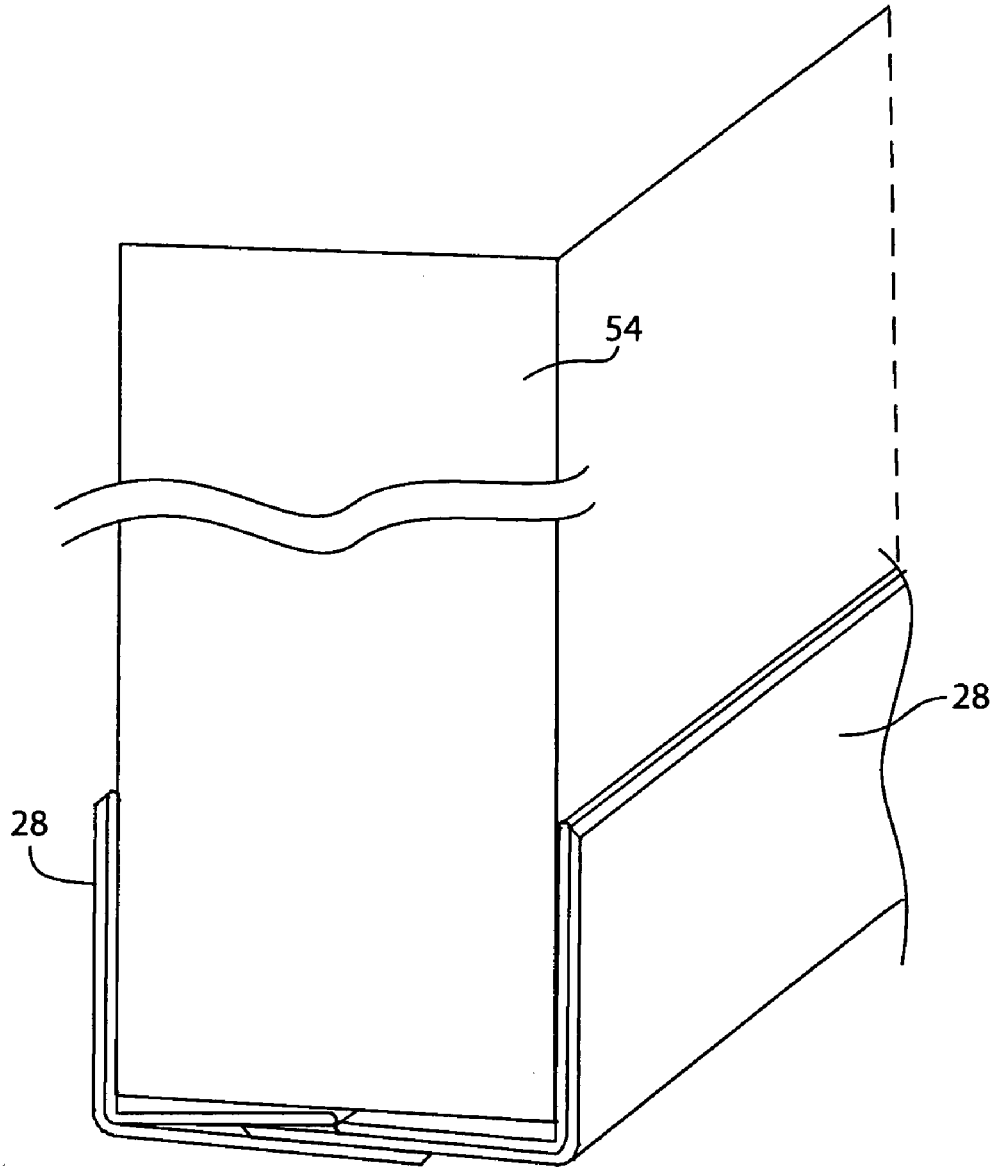
FIG. 2 is a perspective view illustrating the system of the present invention utilizing a pair of corner protectors constructed in accordance with the present invention.
Figure 4:
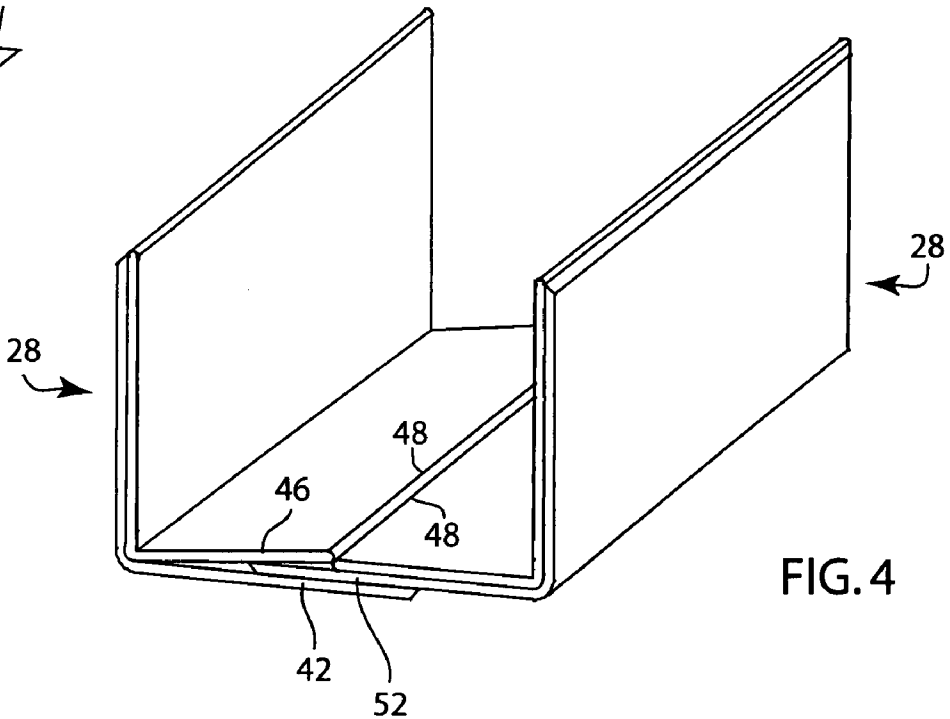
FIG. 4 is a perspective view illustrating the interaction between a pair of corner protectors constructed in accordance with the present invention.
Figure 3:
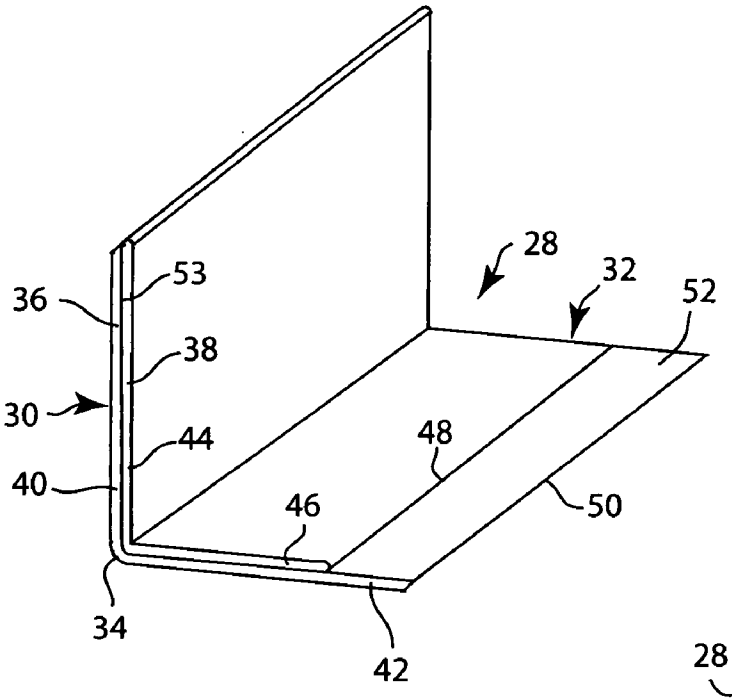
FIG. 3 is a perspective view illustrating one of the corner protectors of the present invention.

Referring now to FIGS. 2–4, thereshown is the packaging system of the present invention. As best illustrated in FIGS. 3–4, the packaging system includes an improved corner protector 28, as best illustrated in FIG. 3. The corner protector 28 includes a first leg 30 and a second leg 32 joined to each other along a corner 34. Preferably, the corner 34 defines a 90° angle such that the corner protector 28 has a generally V-shape.

As illustrated in FIG. 3, the corner protector 28 is formed from an outer layer 36 and an inner layer 38, each of which include a pair of legs. As illustrated in FIG. 3, the first leg 40 of the outer layer 36 has the same length as the second leg 42. The inner layer 38 also includes a first leg 44. However, the second leg 46 has a length less than the length of the first leg 44. Thus, the edge 48 of the second leg 46 is spaced inward from the outer edge 50 of the second leg 42 of the outer layer 36. Thus, the thickness of the corner protector 38 is reduced along an overlap area 52 as compared to the remaining portions of the edge protector 28.

As illustrated in FIG. 3, the first leg 40 of the outer layer 36 is joined to the first leg 44 of the inner layer 38 by an adhesive along line 53. Thus, the outer layer 36 and the inner layer 38 are secured to form a single structure along this area.

Referring now to FIG. 4, the second leg 42 of the outer layer 36 is not adhesively attached to the second leg 46 of the inner layer such that the second legs 42 and 46 can be separated, as illustrated. As shown in FIG. 4, a pair of the corner protectors 28 can be mated to each other such that the overlap area 52 of the right corner protector 28 is placed between the second legs 42 and 46 of the left corner protector 28. When the corner protectors 28 are configured as illustrated, the edges 48 of the two corner protectors 28 generally abut each other to form a smooth surface along the bottom of the combined edge protectors. Further, since the corner protectors 28 are press fit into contact with each other, rivets are no longer required to secure the two components to each other.

Referring now to FIG. 2, thereshown are a pair of corner protectors 28 joined to each other to define a U-shaped edge protector to provide protection to three edges of a product 54.

As discussed above, advantages of the corner protector 28 of the present invention are obvious and include the elimination of rivets to prevent scratching to a product being shipped, the creation of a smooth inside surface along the bottom of the combined protectors and the interaction between the two corner protectors to prevent damage to a product being shipped. Further, since each of the corner protectors can be quickly and easily mated with another corner protector, each corner protector 28 can be stored in a nested condition to both lower freight costs and reduce the storage area required in a user's plant. Further, since the components are press fit together, no additional labor costs are required to assemble the device, as was the case with a riveted connection shown in FIG. 1.

Various alternatives and embodiments are contemplated as being within the scope of the following claims particularly pointing out and distinctly claiming the subject matter regarded as the invention.

I claim:

1. A product protector for protecting three edges of a product being shipped, the product protector comprising:

a pair of interlocking corner protectors, each corner protector having an inner layer and an outer layer, the inner and outer layers being partially joined together along one portion and being separable along another portion wherein an area of the outer layer on one of the corner protectors is press fit between the separable inner and outer layers on the other of the corner protectors to define a generally U-shaped edge protector to protect the three edges of the product.

2. The product protector of claim 1, wherein each of the corner protectors has a generally V-shape.

3. The product protector of claim 1, wherein each outer layer has a first leg joined to a second leg, the first leg and the second leg having the same dimensions.

4. The product protector of claim 3, wherein each inner layer has a first leg joined to a second leg, the first leg of the inner layer having generally a length equal to the first leg of the outer layer, and the second leg of the inner layer being shorter in length than the length of the second leg of the outer layer.

5. The product protector of claim 4, wherein the first leg of the outer layer and the first leg of the inner layer are secured together along their entire length.

6. The product protector of claim 4, wherein the second leg of the outer layer is separated from the second leg of the inner layer to form an overlap area between an outer edge of the second leg of the inner layer and an outer edge of the second leg of the outer layer.

7. The product protector of claim 6, wherein the overlap area on the one corner protector is positioned between the second leg of the outer layer and the second leg of the inner layer on the other corner protector.

8. The product protector of claim 6, wherein with one of the corner protectors press fit into the other of the corner protectors, outer edges of the second legs of the inner layers of the corner protectors abut each other such that the adjoining second legs of the inner surfaces create a smooth inside surface for supporting one edge of the product being shipped.

9. The product protector of claim 1, wherein one of the corner protectors is interlocked with the other of the corner protectors independent of fasteners.

10. The product protector of claim 1, wherein the inner and outer layers are constructed from laminated paperboard.

11. The product protector of claim 5, wherein the first leg of the outer layer and the first leg of the inner layer are secured together by an adhesive.

12. A method for forming a product protector used to protect three edges of a product being shipped, the method comprising the steps of:

providing a pair of interlocking corner protectors, each corner protector having an inner layer and an outer layer;

partially joining the inner and outer layers together along one portion thereof and keeping the inner and outer layers separable along another portion thereof; and press fitting an area of the outer layer on one of the corner protectors between the separable portion of the inner and outer layers on the other of the corner protectors to form a generally U-shaped edge protector for protecting the three edges of the product being shipped.

* * * * *